US008262260B2

(12) United States Patent
Mo et al.

(10) Patent No.: US 8,262,260 B2
(45) Date of Patent: Sep. 11, 2012

(54) LAMP WITH SIDE EMITTING LED AND HEAT SINK

(75) Inventors: Ci-Jin Mo, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 329 days.

(21) Appl. No.: 12/753,127

(22) Filed: Apr. 2, 2010

(65) Prior Publication Data

US 2011/0169391 A1 Jul. 14, 2011

(30) Foreign Application Priority Data

Jan. 13, 2010 (CN) ..... 2010 1 0300239

(51) Int. Cl.
*F21V 29/00* (2006.01)

(52) U.S. Cl. ..... 362/294; 362/249.02; 362/249.06; 362/373

(58) Field of Classification Search ..... 362/545, 362/547, 249.02, 249.06, 249.14, 294, 373, 362/218, 225
See application file for complete search history.

(56) References Cited

U.S. PATENT DOCUMENTS

| | | | | | |
|---|---|---|---|---|---|
| 5,567,036 | A * | 10/1996 | Theobald et al. | ..... | 362/485 |
| 5,688,042 | A * | 11/1997 | Madadi et al. | ..... | 362/240 |
| 5,949,347 | A * | 9/1999 | Wu | ..... | 340/815.45 |
| 6,499,860 | B2 * | 12/2002 | Begemann | ..... | 362/230 |
| 7,255,460 | B2 * | 8/2007 | Lee | ..... | 362/294 |
| 7,588,347 | B1 * | 9/2009 | Edwards, Jr. | ..... | 362/225 |
| 7,611,264 | B1 * | 11/2009 | Chang et al. | ..... | 362/249.02 |
| 7,832,899 | B2 * | 11/2010 | Zheng | ..... | 362/249.02 |
| 2007/0041220 | A1 * | 2/2007 | Lynch | ..... | 362/646 |
| 2007/0159828 | A1 * | 7/2007 | Wang | ..... | 362/294 |
| 2008/0092800 | A1 * | 4/2008 | Smith et al. | ..... | 362/221 |
| 2011/0002116 | A1 * | 1/2011 | Chen et al. | ..... | 362/235 |

* cited by examiner

*Primary Examiner* — Ismael Negron
(74) *Attorney, Agent, or Firm* — Altis Law Group, Inc.

(57) ABSTRACT

An LED lamp includes a heat sink including a supporting plate, a plurality of LEDs mounted on the supporting plate and a heat-conducting mounting wall extending upwardly from a top face of the supporting plate. The heat-conducting mounting wall has inclined outer faces oriented upwardly. The LEDs includes a plurality of first LEDs disposed on a bottom face of the supporting plate and a plurality of second LEDs disposed on the inclined outer faces of the heat-conducting mounting wall, whereby light generated from the second LEDs projects towards a lateral side of the LED lamp.

19 Claims, 4 Drawing Sheets

LAMP WITH SIDE EMITTING LED AND HEAT SINK

BACKGROUND

1. Technical Field

The disclosure relates to LED (light emitting diode) lamps for illumination purpose and, more particularly, relates to an improved LED lamp having a large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages; they are now used as street lamps, lawn lamps or home lamps for illumination purpose. Known implementations of an LED module in the LED lamp make use of a plurality of individual LEDs to generate light that is ample and of satisfactory spatial distribution. The large numbers of LEDs, however, increase price and power consumption of the module. Considerable heat is also generated, which, if not adequately addressed at additional expense, impacts the reliability of the LED lamp. Further, since the LEDs are generally arranged on a printed circuit board having a flattened face, light emitted from the LEDs is concentrated on a small area confronting the LEDs due to high directivity of the LEDs, which is unsuitable for environments requiring an even and broad illumination. Thus, the LEDs mounted on the flattened face of the printed circuit board cannot have a large area of illumination.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
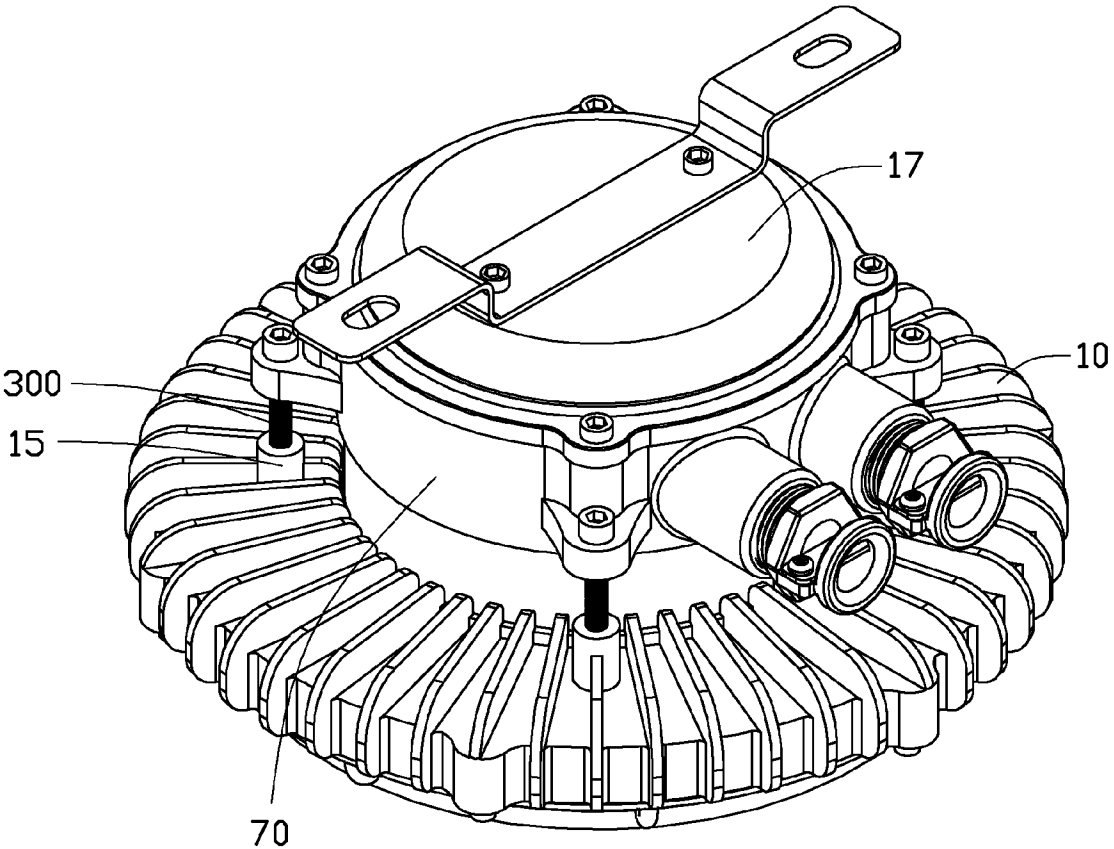
FIG. 1 is an isometric, assembled view of an LED lamp in accordance with an embodiment of the disclosure.
Figure 2:
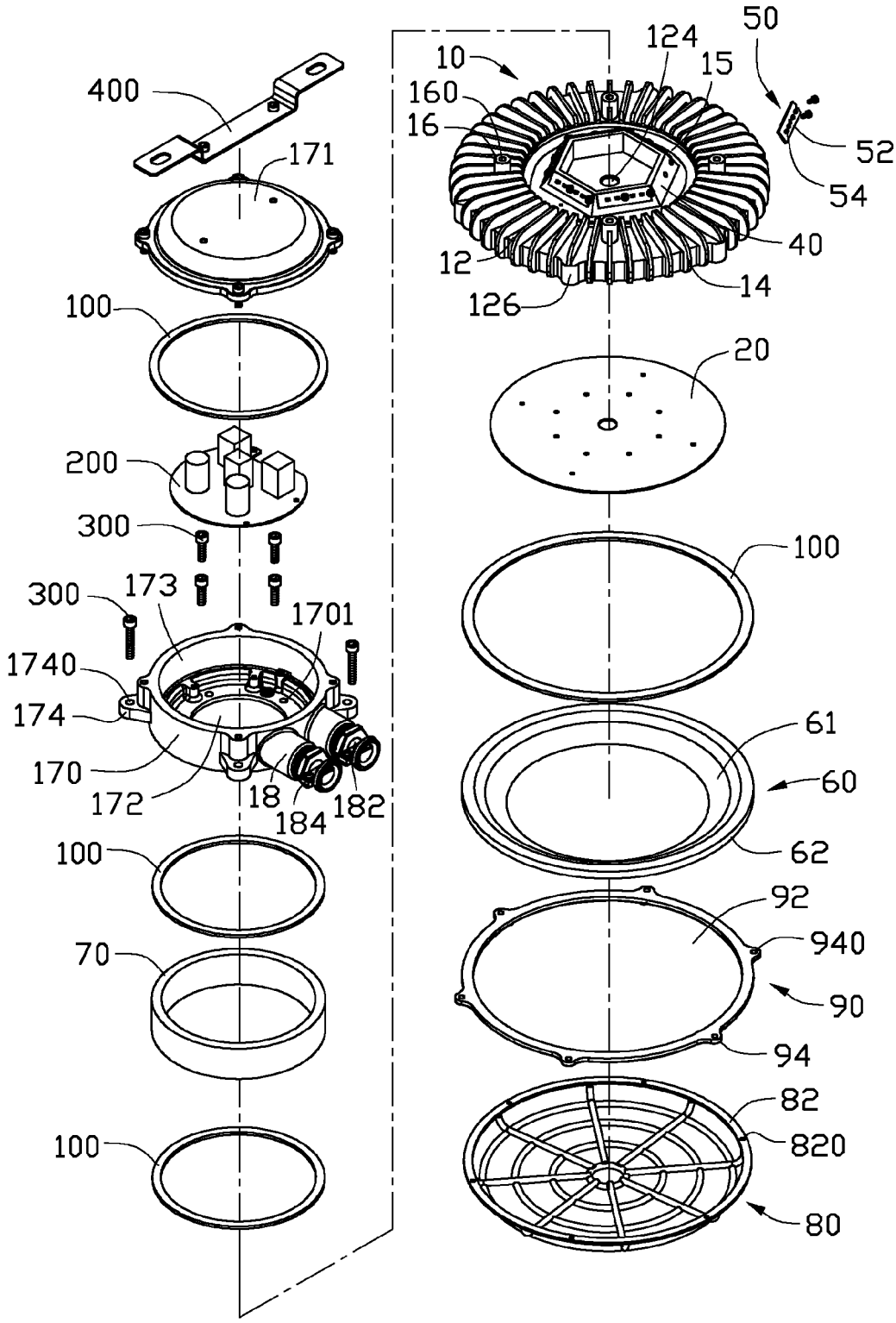
FIG. 2 is an exploded view of the LED lamp of FIG. 1.

Referring to FIGS. 1 and 2, a light emitting diode (LED) lamp in accordance with an embodiment of the disclosure is illustrated. The LED lamp comprises a heat sink 10, a first LED module 20 thermally attached to a bottom face of the heat sink 10, a heat-conducting, hexagonal mounting wall 40 extending upwardly from a top face of the heat sink 10, a plurality of second LED modules 50 thermally attached to the mounting wall 40, a first envelope 60 mounted on the bottom face of the heat sink 10 and correspondingly covering the first LED module 20, a second envelope 70 mounted on the top face of the heat sink 10 and correspondingly enclosing the second LED modules 50 therein, a pressing frame 90 securing the first envelope 60 to the heat sink 10 and a protecting cage 80 being secured to the pressing frame 90 to cover and protect the first envelope 60.

Figure 3:
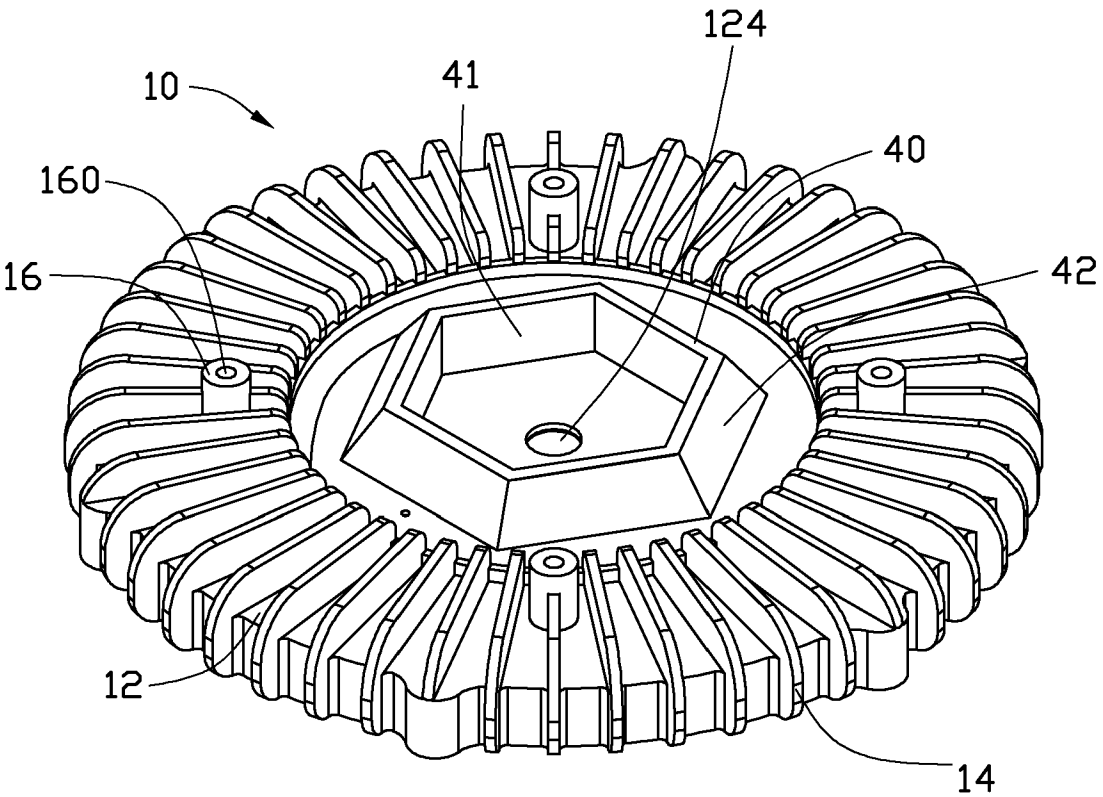
FIG. 3 shows a heat sink of the LED lamp of FIG. 1.
Figure 4:
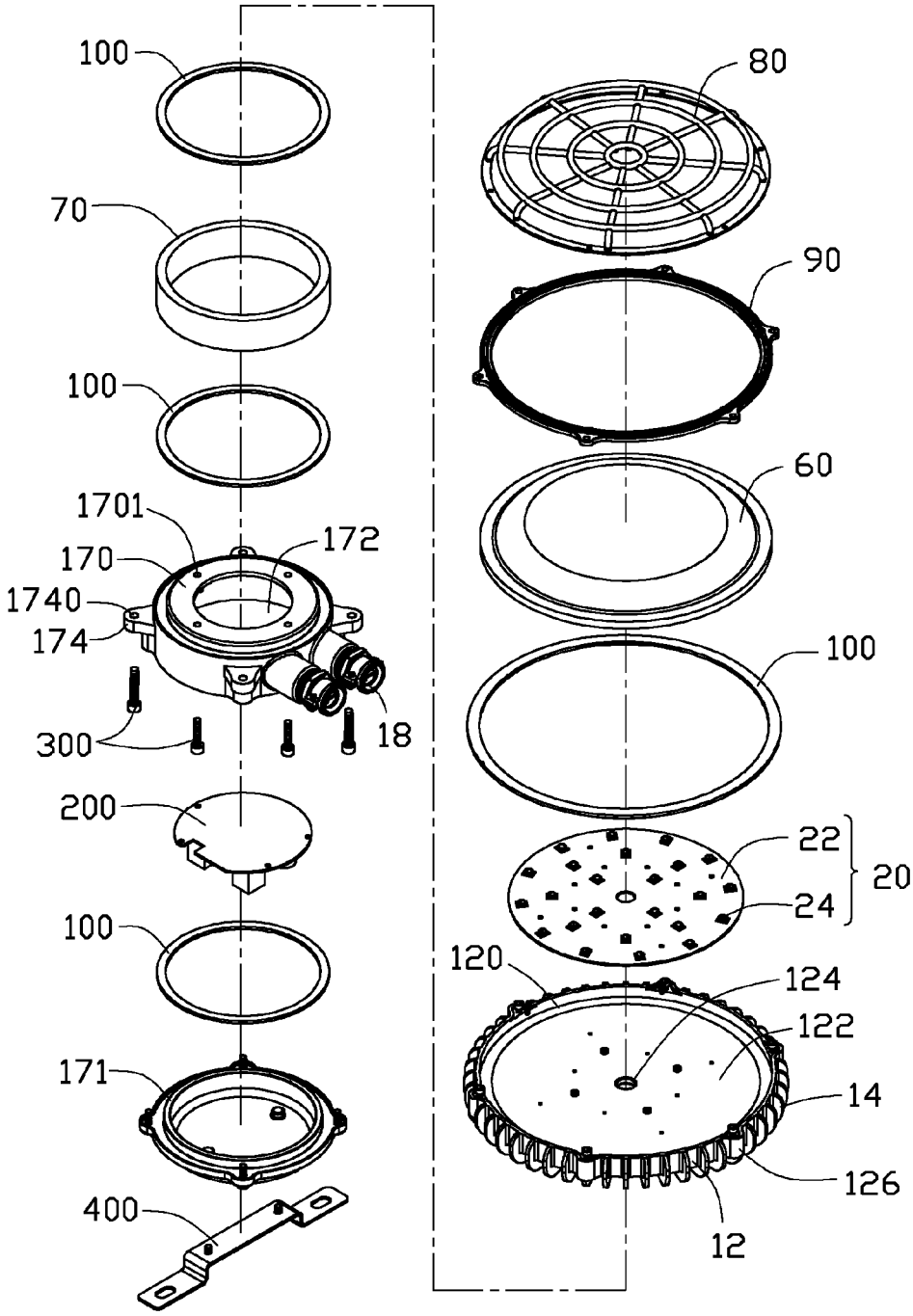
FIG. 4 is an inverted, exploded view of the LED lamp of FIG. 1.

Referring to FIGS. 3 and 4 also, the heat sink 10 is integrally made of a metal with good heat conductivity such as aluminum, copper or an alloy thereof. The heat sink 10 comprises a circular supporting plate 12 and a plurality of fins 14 extending outwardly from a top and an outer circumference of the supporting plate 12. An annular receiving groove 120 is defined along an outer periphery of a bottom face of the supporting plate 12 for receiving an annular sealing gasket 100 therein. The first envelope 60 is mounted on the bottom face of the supporting plate 12 with a periphery of the first envelope 60 engaging with the sealing gasket 100 so that the first envelope 60 is hermetically connected to the supporting plate 12 of the heat sink 10. A circular protrusion 122 is formed at a central area of the supporting plate 12 and surrounded by the receiving groove 120. A through hole 124 is defined in a center of the protrusion 122 of the supporting plate 12 for extension of electrical wires (not shown) therethrough to electrically connect with the first LED module 20. A plurality of protruding ribs 126 protrude outwardly and perpendicularly from the outer circumference of the supporting plate 12. The protruding ribs 126 are equally spaced from each other. The protruding ribs 126 protrude radially outwardly and extend along a top-to-bottom direction of the supporting plate 12, and each have a semicircular cross-section along a horizontal direction. A screw hole is defined in a central portion of a bottom end of each protruding rib 126.

The mounting wall 40 extends upwardly from a center of a top face of the supporting plate 12. An annular first groove 15 is defined at the top face of the supporting plate 12 for receiving an annular sealing gasket 100 therein. The mounting wall 40 is surrounded by the first groove 15. The fins 14 are arranged radially relative to the first groove 15. A passage (not labeled) is defined between every two neighboring fins 14. The second envelope 70 is mounted on the top face of the supporting plate 12, with a periphery of the second envelope 70 engaging with the sealing gasket 100 whereby the second envelope 70 is hermetically connected to the supporting plate 12 of the heat sink 10. A plurality of engaging columns 16 are formed on the top face of the supporting plate 12. The engaging columns 16 are located surrounding the second envelope 70. A screw hole 160 is defined at a top of each engaging column 16.

In this embodiment of the present disclosure, the mounting wall 40 has a configuration like a frustum of a hollow pyramid and defines a central hole 41 at a center thereof. The central hole 41 communicates with the through hole 124 of the supporting plate 12. The mounting wall 40 defines six inclined faces 42 oriented upwardly at an outer circumference thereof. A width of the mounting wall 40 decreases gradually along a direction from the supporting plate 12 toward a top of the mounting wall 40. The inclined faces 42 face radially outwardly in respect to the central hole 41 of the mounting wall 40. The inclined faces 42 are centrosymmetrical relative to the through hole 124 of the supporting plate 12. Alternatively, the number of the inclined faces 42 can be varied to other suitable values according to different requirements.

The first LED module 20 comprises a circular first printed circuit board 22 and a plurality of first LEDs 24 mounted on the first printed circuit board 22. The first printed circuit board 22 is thermally attached on the bottom face of the supporting plate 12 of the heat sink 10, and the first LEDs 24 are arranged evenly on the printed circuit board 22 and spaced from each other. It is understood that the first printed circuit board 22 is a base which can support the first LEDs 24 and electrically connect the first LEDs 24 to a power supply.

The first envelope 60 is integrally formed of a transparent or semitransparent material such as glass, resin or plastic. The first envelope 60 comprises a bowl-shaped body 61 and an engaging flange 62 extending outwardly and horizontally from a periphery of a top end of the body 61. The engaging flange 62 has a size larger than the receiving groove 120 of the supporting plate 12. When the first envelope 60 is connected to the heat sink 10, the engaging flange 62 covers the receiving groove 120, and the sealing gasket 100 is sandwiched between the engaging flange 62 and the supporting plate 12 for increasing the sealing performance of the LED lamp.

The pressing frame 90 is annular and defines a hole 92 at a center thereof. A plurality of spaced protruding tabs 94 extend radially and outwardly from an outer periphery of the pressing frame 90. The pressing frame 90 has a diameter substantially equal to that of the engaging flange 62 of the first envelope 60. The protruding tabs 94 are evenly distributed along a circumference of the pressing frame 90. Each of the protruding tabs 94 is about semicircular-shaped, and defines a securing hole 940 at a center thereof. The securing holes 940 of the protruding tabs 94 are aligned with the protruding ribs 126 of the heat sink 10, respectively. Fasteners (not shown) are brought to extend through the securing holes 940 and threadedly engage in the protruding ribs 126 to thereby secure the pressing frame 90 to the heat sink 10.

The protecting cage 80 has a shape corresponding to that of the first envelope 60, and has a size slightly larger than the first envelope 60. The protecting cage 80 comprises a plurality of wires (not labeled) interlaced with each other. The protecting cage 80 is configured as a bowl-shaped mesh having a plurality of openings between the wires. A pressing flange 82 extends horizontally and outwardly from a top end of the protecting cage 80. A plurality of apertures 820 are defined along a circumference of the pressing flange 82. Fasteners (not shown) are extended through the apertures 820 into the pressing frame 90 to secure the protecting cage 80 to the pressing frame 90.

Each of the second LED modules 50 comprises an elongated second printed circuit board 52 and a plurality of second LEDs 54 mounted on the second printed circuit board 52. The second printed circuit board 52 is slantwise attached on a corresponding inclined face 42 of the mounting wall 40, and the second LEDs 54 are arranged evenly on the printed circuit board 52.

The second envelope 70 has a tubular shape with a through hole (not labeled) defined therein. Two opposite ends of the second envelope 70 each have a diameter similar to that of the first groove 15 of the heat sink 10. A bottom end of the second envelope 70 is fixed to the top face of the supporting plate 12 defining the first groove 15 and engages with the sealing gasket 100, whereby a hermetical connection between the bottom end of the envelope 70 and the supporting plate 12 of the heat sink 10 is attained. The second envelope 70 is made of a transparent or semitransparent material such as glass, plastic, etc., for allowing light emitted by the second LED modules 50 passing therethrough.

A hollow mounting member 17 is disposed on a top end of the second envelope 70. The hollow mounting member 17 defines a receiving chamber 173 for accommodating a driving module 200 therein. The second envelope 70 is sandwiched uprightly between the supporting plate 12 of the heat sink 10 and the mounting member 17. Two safety connectors 18 are further provided to the mounting member 17 for allowing the electrical wires to extend therethrough into/out the receiving chamber 173. The mounting member 17 comprises a cylindrical main body 170 which defines an opening (not labeled) at a top thereof and a cover 171 disposed on the main body 170 and sealing the opening. The main body 170 comprises a circular bottom wall (not labeled) and a cylindrical sidewall (not labeled) extending perpendicularly and upwardly from an outer periphery of the bottom wall. A connecting hole 172 is defined at a center of the bottom wall for the electrical wires extending therethrough to connect with the second LED modules 50. A plurality of protruding blocks 174 protrude outwardly from an outer circumference of the sidewall of the main body 170. The protruding blocks 174 are spaced from each other. A through hole 1740 is defined in each protruding block 174. A plurality of screwing members 300 are correspondingly extended through the through holes 1740 of the protruding blocks 174 and screwed into the screw holes 160 of the engaging columns 16. A plurality of through apertures 1701 are defined in the bottom wall of the main body 170. A plurality of additional screwing members 300 are correspondingly extended through the through apertures 1701 of the mounting member 17 and screwed into the heat sink 10. Two mounting holes (not labeled) are juxtaposedly defined in one side of the sidewall of the mounting member 17. The two safety connectors 18 are threadedly engaged in the mounting holes, respectively.

The safety connector 18 is tubular and defines a central hole (not labeled) corresponding to the mounting hole for extension of the electrical wires. A cutout 182 is defined in one side of the safety connector 18 for receiving a pressing piece 184 therein. The cutout 182 communicates with the central hole (not labeled) for exposing a portion of the electrical wires received in the safety connector 18. The pressing piece 184 is arced, and defines two fixing holes (not labeled) at two opposite ends thereof. The pressing piece 184 is connected to the safety connector 18 via bolts (not shown) extending through the fixing holes thereof and screwing into the safety connector 18. The pressing piece 184 tightly secures the electric wires against an inner face of the safety connector 18, whereby the electrical wires are reliably held in the central hole via the pressing piece 184.

A fixing bracket 400 is disposed on the cover 171 of the mounting member 17. The fixing bracket 400 is an elongated and bended sheet, and comprises an upright U-shaped fixing portion (not labeled) which is fixed on the cover 171 and two arms (not labeled) extending outwardly and horizontally from two opposite sides of the fixing portion. In use, the LED lamp can be fixed to a wall or a ceiling via the fixing bracket 400.

In assembly, the first LED module 20 is mounted on the bottom face of the supporting plate 12; the second LED modules 50 are correspondingly attached to the inclined faces 42 of the mounting wall 40; the engaging flange 62 of the first envelope 60 is hermetically connected to the bottom face of the supporting plate 12 defining the receiving groove 120 of the heat sink 10 to receive the first LED module 20 therein; the second envelope 70 is hermetically sandwiched between the heat sink 10 and the mounting member 17 to thereby receive the second LED modules 50 therein; the pressing frame 90 is disposed on the first envelope 60 and fixed to the heat sink 10 to press the first envelope 60 against the heat sink 10, wherein the protruding tabs 94 of the pressing frame 90 horizontally protrude outside of the engaging flange 62 and located just below the protruding ribs 126, respectively; the protecting cage 80 surrounds an outer periphery of the first envelope 60 with the pressing flange 82 thereof securely fixed to the pressing frame 90.

The above-described LED lamp can be applied in various occasions to meet large-area illumination requirements thereof. For example, the LED lamp could be secured to a ceiling via the fixing bracket 400. The light generated by the first LED modules 20 is directly transmitted through the first envelope 60 toward an area below the lamp, and projects outwardly. The mounting wall 40 has the inclined faces 42 on which the second LED modules 50 are mounted. Accordingly, light emitted by the second LED modules 50 is radiated upwardly and outwardly and thus distributed over a large region. Thus, the first and second LED modules 20, 50 of the LED lamp can generate light that radiate along multiple directions, i.e., along the downward direction and the lateral direction, to thereby provide a large-area illumination. The light from the second LED module 50 also radiates upwardly. Thus, the LED lamp in accordance with present disclosure can have a large illumination area. In addition, when the first and second LED modules 20, 50 emit light, heat generated by the first LEDs 24 is absorbed by the heat sink 10, and heat generated by the second LEDs 54 is absorbed by the hollow mounting wall 40, and then transferred to the heat sink 10. Finally, the heat is dispersed into ambient air via the fins 14. Furthermore, the central hole 41 of the mounting wall 40 and the through hole 124 of the supporting plate 12 located at a central portion of the LED lamp communicates with each other, whereby helping natural air convection through the heat sink 10.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink comprising a supporting plate and a heat-conducting mounting wall extending upwardly from a top face of the supporting plate, the heat-conducting mounting wall having inclined outer faces oriented upwardly; and a plurality of LEDs mounted on the supporting plate, and the LEDs comprising a plurality of first LEDs disposed on a bottom face of the supporting plate and a plurality of second LEDs;

wherein the second LEDs are disposed on the inclined outer faces of the heat-conducting mounting wall, whereby light generated from the second LEDs projects towards a lateral side of the LED lamp; and wherein the heat-conducting mounting wall defines a central hole at a center thereof.

2. The LED lamp as described in claim 1, wherein a width of the heat-conducting mounting wall gradually decreases along an upward direction away from the supporting plate.

3. The LED lamp as described in claim 1, wherein the heat-conducting mounting wall has a configuration like a frustum of a hollow pyramid.

4. The LED lamp as described in claim 1, wherein the supporting plate defines a through hole, the central hole communicates with the through hole of the supporting plate.

5. The LED lamp as described in claim 1, wherein the inclined outer faces face radially outwardly in respect to the central hole of the heat-conducting mounting wall, and the heat-conducting mounting wall is hexagonal.

6. The LED lamp as described in claim 1, wherein the light emitted from the first LEDs is radiated downwardly and the light emitted from the second LEDs is radiated also upwardly.

7. The LED lamp as described in claim 1, wherein an annular receiving groove is recessed from a periphery of the bottom face of the supporting plate, a sealing gasket being received in the annular receiving groove.

8. The LED lamp as described in claim 7 further comprising a first envelope which comprises a bowl-shaped body and an engaging flange extending outwardly from a periphery of the body, and the engaging flange is fixed to the bottom face of the supporting plate of the heat sink defining the receiving groove.

9. The LED lamp as described in claim 8 further comprising an annular pressing frame disposed on the engaging flange of the first envelope for securing the first envelope to the heat sink.

10. The LED lamp as described in claim 8 further comprising a protecting cage covering an outer face of the first envelope, the protecting cage comprising a plurality of wires interlaced with each other.

11. The LED lamp as described in claim 1 further comprising a mounting member for receiving a driving module therein.

12. The LED lamp as described in claim 11 further comprising a tubular second envelope disposed on the top face of the supporting plate and enclosing the second LEDs and the heat-conducting mounting wall therein, wherein the second envelope is hermetically sandwiched between the supporting plate and the mounting member.

13. The LED lamp as described in claim 12 further comprising a plurality of protruding blocks protruding outwardly from an outer circumference of the mounting member.

14. The LED lamp as described in claim 13 further comprising a plurality of screwing members correspondingly extended through the protruding blocks and screwed into the supporting plate.

15. The LED lamp as described in claim 14, wherein the screwing members are located surrounding the second envelope.

16. An LED lamp comprising:

a heat sink comprising a supporting plate and a heat-conducting mounting wall extending upwardly from a top face of the supporting plate, the heat-conducting mounting wall having inclined outer faces oriented upwardly; and a plurality of LEDs mounted on the supporting plate, and the LEDs comprising a plurality of first LEDs disposed on a bottom face of the supporting plate and a plurality of second LEDs disposed on the inclined outer faces of the heat-conducting mounting wall, whereby light generated from the second LEDs projects towards a lateral side of the LED lamp;

wherein an annular receiving groove is recessed from a periphery of the bottom face of the supporting plate, a sealing gasket being received in the annular receiving groove.

17. An LED lamp comprising:

a heat sink comprising a supporting plate and a heat-conducting mounting wall extending upwardly from a top face of the supporting plate, the heat-conducting mounting wall having inclined outer faces oriented upwardly; and a plurality of LEDs mounted on the supporting plate, and the LEDs comprising a plurality of first LEDs disposed on a bottom face of the supporting plate and a plurality of second LEDs disposed on the inclined outer faces of the heat-conducting mounting wall, whereby light generated from the second LEDs projects towards a lateral side of the LED lamp;

a mounting member for receiving a driving module therein; and a tubular second envelope disposed on the top face of the supporting plate and enclosing the second LEDs and the heat-conducting mounting wall therein, wherein the second envelope is hermetically sandwiched between the supporting plate and the mounting member.

18. The LED lamp as described in claim 17 wherein an annular receiving groove is recessed from a periphery of the bottom face of the supporting plate, a sealing gasket being received in the annular receiving groove.

19. The LED lamp as described in claim 18 further comprising a first envelope which comprises a bowl-shaped body and an engaging flange extending outwardly from a periphery of the body, and the engaging flange is fixed to the bottom face of the supporting plate of the heat sink defining the receiving groove.

* * * * *